US007724226B2

(12) United States Patent
Takahashi

(10) Patent No.: US 7,724,226 B2
(45) Date of Patent: May 25, 2010

(54) DRIVING CIRCUIT AND DRIVING METHOD FOR LIQUID CRYSTAL DISPLAY PANEL

(75) Inventor: Mitsuasa Takahashi, Kanagawa (JP)

(73) Assignee: NEC LCD Technologies, Ltd., Kanagawa (JP)

( * ) Notice: Subject to any disclaimer, the term of this patent is extended or adjusted under 35 U.S.C. 154(b) by 836 days.

(21) Appl. No.: 11/561,635

(22) Filed: Nov. 20, 2006

(65) Prior Publication Data

US 2007/0120791 A1 May 31, 2007

(30) Foreign Application Priority Data

Nov. 28, 2005 (JP) ..... 2005-341783

(51) Int. Cl.
*G09G 3/36* (2006.01)

(52) U.S. Cl. ..... 345/89; 345/87; 345/98; 345/690

(58) Field of Classification Search ..... 345/87–89, 345/95–101, 208, 210, 690; 326/82
See application file for complete search history.

(56) References Cited

U.S. PATENT DOCUMENTS

| | | | | |
|---|---|---|---|---|
| 6,876,347 | B2 * | 4/2005 | Tashiro et al. | 345/87 |
| 7,382,349 | B1 * | 6/2008 | Kuhns | 345/102 |
| 2003/0058264 | A1 * | 3/2003 | Takako et al. | 345/698 |
| 2003/0098839 | A1 * | 5/2003 | Lee | 345/89 |
| 2003/0107546 | A1 * | 6/2003 | Ham | 345/101 |
| 2004/0095306 | A1 * | 5/2004 | Fujiyoshi | 345/94 |
| 2005/0140399 | A1 * | 6/2005 | Kim et al. | 327/108 |
| 2005/0146495 | A1 * | 7/2005 | MacKinnon et al. | 345/98 |
| 2005/0258997 | A1 | 11/2005 | Kim et al. | |
| 2006/0125748 | A1 * | 6/2006 | Yang et al. | 345/88 |
| 2006/0290635 | A1 * | 12/2006 | Fratti et al. | 345/98 |
| 2008/0068318 | A1 * | 3/2008 | Kerwin | 345/89 |

FOREIGN PATENT DOCUMENTS

| | | | |
|---|---|---|---|
| JP | 4-365094 | A | 12/1992 |
| JP | 2003-172915 | A | 6/2003 |
| JP | 2004-287139 | A | 10/2004 |

* cited by examiner

*Primary Examiner*—Amare Mengistu
*Assistant Examiner*—Hong Zhou
(74) *Attorney, Agent, or Firm*—Sughrue Mion, PLLC

(57) ABSTRACT

A driving circuit for a LCD (Liquid Crystal Display) panel is provided which is capable of performing overdriving operations in all shades of gray and of obviating the necessity of predetermining a driving pattern based on experimental results. The driving circuit for the LCD panel includes an operational amplifier to a non-inverted input terminal of which a voltage to charge a pixel for current gray level display is applied and to an inverted input of which a voltage for charging a corresponding pixel occurred one field before, a NAND circuit to detect an output state of operational amplifiers, a P-channel MOSFET (Metal Oxide Semiconductor Field Effect Transistor) to switch operational states from one state in which the operational amplifier operates as a comparator to perform overdriving operations using source voltages to one state in which a pixel to be charged using a gray level voltage.

14 Claims, 7 Drawing Sheets

DRIVING CIRCUIT AND DRIVING METHOD FOR LIQUID CRYSTAL DISPLAY PANEL

BACKGROUND OF THE INVENTION

1. Field of the Invention

The present invention relates to a driving circuit and a driving method for driving an LCD (Liquid Crystal Display) panel.

The present application claims priority of Japanese Patent Application No. 2005-341783 filed on Nov. 28, 2005, which is hereby incorporated by reference.

2. Description of the Related Art

In recent years, as technology of a display device has progressed, a liquid crystal television set using an LCD panel for screen displaying has become commercially practical. FIG. 7 is a diagram showing an example of configurations of a conventional liquid crystal television set using an overdriving operation circuit, as disclosed in prior art Patent Document 1 (Japanese Patent Application Laid-open No. Hei4-365094). In the liquid crystal television set shown in FIG. 7, synchronizing signals extracted through a television (TV) linear circuit 52 from signals received via an image receiving channel and selected by a tuner 51 are output to a synchronizing control circuit 53 and video signals including Y/C (luminance/color) signals are output to an analog to digital (A/D) converting circuit 54. The A/D converting circuit 54 converts input video signals into digital signals.

Video data output from the A/D converting circuit 54 and to be displayed in a current field is compared in a ROM (Read Only Memory) 56 with image data stored in an image memory 55 and obtained one field before and then a signal representing a result from the comparison is output to a segment electrode driving circuit 58. A common electrode driving circuit 57 generates a signal to commonly control each common electrode of a liquid crystal panel 59 in accordance with a synchronizing control signal fed from the synchronizing control circuit 53. In the liquid crystal panel 59, by the above operations, an image is displayed to provide a preset pattern in a manner based on horizontal/vertical synchronizing signals separated by the synchronizing control circuit 53 from signals received through the image receiving channel and in accordance with control signals to commonly control each common electrode fed from the common electrode driving circuit 57 and in a manner driven by using an overdriving voltage based on data in the first frame and by using a voltage of a pixel electrode based on data in the second frame.

According to technology disclosed in prior art Patent Document 1 (Japanese Patent Application Laid-open No. Hei4-365094), it is reported that, by performing overdriving operations to achieve a sharp rise or sharp fall in optical transmittance of an LCD and to improve a response speed of a liquid crystal panel, it is made possible to speedily track an image which changes rapidly.

Also, a liquid crystal display device including a liquid crystal panel having a liquid crystal layer and an electrode to supply a voltage to the liquid crystal layer and a driving circuit to apply a driving voltage to the liquid crystal panel is disclosed in prior art Patent Document 2 (Japanese Patent Application Laid-open No. 2003-172915) in which, when the liquid crystal panel shows an extreme value in a voltage-transmittance characteristic curve at a voltage exceeding a maximum gray level voltage, the driving circuit supplies, in accordance with a combination of an input image signal existed one vertical period before and an input image signal existing during a current vertical period, a driving voltage obtained by overshooting a gray level voltage corresponding to an input image signal occurring during a predetermined current vertical period is applied to the liquid crystal panel and, as a result, a response speed is improved.

Another liquid crystal display device to display an image by using a liquid crystal panel is disclosed in prior art Patent Document 3 (Japanese Patent Application Laid-open No. 2004-287139) in which a first storing means to store a previous image signal occurred one vertical display period before and a second storing means to store a previous image occurred two vertical display periods before, an enhancement converting means to obtain an enhancement converting signal for compensating for changes in optical response characteristics of the liquid crystal display panel from a previous image signal occurred one vertical display period before stored in the first storing means and from an image occurred two previous vertical display periods before stored in the second storing means and an image signal in a current vertical display period are provided and, therefore, when gray-level transition occurs in an input image signal, it is made possible to compensate for changes in optical response characteristics of a liquid crystal display pattern and to make a liquid crystal reach a transmittance (target gray-level luminance) determined by an input image signal without fail after the elapse of one vertical display period, thus enabling a desired gray-level luminance to be displayed all the time and high-quality image display to be achieved.

However, in the conventional driving circuit for the liquid crystal television set shown in FIG. 7, the LCD is driven by performing an overdriving operation using gray level voltages between the minimum gray level voltage and the maximum gray level voltage and, therefore, a wide variety of intermediate shades of gray can be selected, which provides big advantages, however, when a gray level voltage near the maximum gray-level voltage is selected, since a voltage to be used for overdriving is almost equal to a voltage of a pixel electrode, almost no effect can be expected that, by improving a response speed of a liquid crystal panel, an image changing rapidly can be speedily tracked.

SUMMARY OF THE INVENTION

In view of the above, it is an object of the present invention to provide a driving circuit and a driving method for an LCD panel which is capable of performing an overdriving operation in all shades of gray and obviating the necessity for pre-determining a driving pattern based on experimental results or a like.

According to a first aspect of the present invention, there is provided a driving circuit for an LCD panel including:

a pixel charging operational amplifier to a first input terminal of which a voltage to charge a pixel of the LCD for a current gray-scale display is applied and to a second input terminal of which a voltage to charge a corresponding pixel occurred one field before is applied and an output from which is supplied to the pixel and to which a source voltage having a positive or negative voltage range being wider than a gray-level voltage range of the LCD panel is applied;

a charged state detecting unit to detect a charged state of the pixel and to generate an output being different depending on whether a value representing the charged state is within a range of a large deviation from a set value or is within a range of a small deviation from the set value; and a switching unit to cause an OFF state or ON state to occur between the second input terminal of the pixel charging operational amplifier and its output terminal according to an output state of the charged state detecting unit;

wherein, when a value representing a charged state of the pixel is within a range significantly deviating from the set value, the switching unit goes into an OFF state which makes the pixel charging operational amplifier operate as a comparator and makes the pixel to be overdriven using the positive or negative source voltage and, when the value representing a charged state of the pixel is within a range of a small deviation from the set value, the switching unit goes into an ON state which makes the pixel charging unit operate as a buffer and makes the pixel be charged by using a voltage corresponding to a current gray-scale display.

In the foregoing, a preferable mode is one wherein a voltage for charging a corresponding pixel occurred one field before is generated by a field memory device having a memory unit to store the voltage for charging a corresponding pixel occurred one field before as a digital value and a D/A (Digital/Analog) converting unit to convert the digital value into an analog value.

Also, a preferable mode is one wherein the charged state detecting unit includes:

a first operational amplifier to a first input terminal of which a voltage for charging a pixel capacitor is applied and to a second input terminal of which a voltage being slightly lower than a voltage to charge the pixel for a current gray-scale display is applied;

a second operational amplifier to the second input terminal of which the voltage for charging the pixel capacitor and to the first input terminal of which a voltage being slightly higher than a voltage for charging the pixel for a current gray-level display is applied; and a logical operation unit to perform logical operations on an output from the first operational amplifier and an output from the second operational amplifier to generate an output obtained from the logical computation.

Also, a preferable mode is one wherein the charged state detecting unit includes:

an operational amplifier for amplification to amplify a voltage detected by a detecting resistor connected between an output terminal of the pixel charging operational amplifier and the pixel capacitor to obtain a predetermined gain;

an absolute value circuit to full-wave rectify a voltage output from the operational amplifier for amplification and to generate an output having a specified signal; and an operational amplifier for comparison to compare a voltage output from the absolute circuit with a specified voltage having a same signal as the voltage output from the absolute circuit to generate an output obtained from the comparison.

Also, a preferable mode is one wherein the switching unit includes a P-channel MOSFET (Metal-Oxide Semiconductor Field Effect Transistor) whose gate is connected between a second input terminal of the pixel charging operational amplifier and its output terminal is connected to an output terminal of the charged state detecting unit and wherein, when an output from the charged state detecting unit is at a high level, an OFF state occurs between the second input terminal of the pixel charging operational amplifier and its output terminal and, when an output from the charged state detecting unit is at a low level, an OFF state occurs between the second input terminal of the pixel charging operational amplifier and its output terminal.

Also, a preferable mode is one wherein the switching unit includes a N-channel MOSFET whose gate connected between the second input terminal of the pixel charging operational amplifier and its output terminal is connected to an output terminal of the charged state detecting unit and wherein, when an output from the charged state detecting unit is at a low level, an OFF state occurs between the second input terminal of the pixel charging operational amplifier and its output terminal and, when an output from the charged state detecting unit is at a high level, an ON state occurs between the second input terminal of the pixel charging operational amplifier and its output terminal.

Also, a preferable mode is one wherein the switching unit includes a CMOS (Complementary Metal-Oxide Semiconductor) connected between the second input terminal of the pixel charging operational amplifier and its output terminal and whose control input is connected to an output terminal of the charged state detecting unit and wherein, when an output from the charged state detecting unit is at a low level, an OFF state occurs between the second input terminal of the pixel charging operational amplifier and its output and, when an output from the charged state is at a high level, an ON state occurs between the pixel charging operational amplifier and its output.

According to a second aspect of the present invention, there is provided a method for driving an LCD panel including:

overdriving a pixel in an LCD using a voltage having an absolute value being larger than that of a maximum difference in gray level voltage, whichever direction, in positive or negative direction, a voltage difference between a current gray level voltage for a pixel and a gray level voltage for a corresponding pixel occurred one field before becomes maximum.

According to a third aspect of the present invention, there is provided a method for driving an LCD panel including:

stopping overdriving operations to be performed on a pixel in the LCD panel automatically when it is detected that a voltage level for charging a pixel has become sufficiently close to a gray level voltage level or that a charging current value for a pixel has become a sufficiently small value.

With the above configuration, a voltage for charging a pixel electrode is input to a non-inverted input terminal of the operational amplifier which operates in a voltage range being wider than a gray level voltage range of the LCD panel and a voltage for charging a corresponding pixel occurred one field before is input to an inverted input terminal to detect a charged state of a pixel electrode and, when a value representing a charged state approaches a preset value, the switching circuit connected between an output terminal of the operational amplifier and its inverted terminal is turned ON which switches operations of the operational amplifier from the comparator to the buffer and, therefore, an overdriving operation is made possible in all shades of gray and, when a voltage of a pixel electrode approaches a set voltage, the overdriving operations are stopped and, as a result, the predetermination of a driving pattern based on experimental results is not required and an effect of being applied easily to various kinds of products can be obtained.

BRIEF DESCRIPTION OF THE DRAWINGS

The above and other objects, advantages, and features of the present invention will be more apparent from the following description taken in conjunction with the accompanying drawings in which.

DETAILED DESCRIPTION OF THE PREFERRED EMBODIMENTS

Best modes of carrying out the present invention will be described in further detail using various embodiments with reference to the accompanying drawings.

The driving circuit for an LCD panel of the present invention includes a pixel charging operational amplifier to a non-inverted input terminal of which a voltage to charge a pixel of the LCD panel for displaying in a current shade of gray is applied and to an inverted input terminal of which a corresponding charging voltage occurred one field before is applied and an output terminal of which is connected to a pixel and to which a source voltage a having positive or negative voltage range being wider than a gray level voltage range of the LCD panel is applied, a charged state detecting unit to generate an output being different depending on whether a value representing the charged state is within a range deviating sufficiently from a set value or is within a range of a small deviation from the set value, a switching unit to make an OFF state or an ON state occur between the inverted input terminal and the output terminal of the pixel charging operational amplifier, wherein, when a value representing a charged state of the pixel is within a range deviating significantly from a set value, the switching unit goes into an OFF state which causes the pixel charging operational amplifier to operate as a comparator and causes a pixel to be overdriven using a positive or negative source voltage and, when the value representing the charged state of a pixel is near to the set value, the switching unit goes into an ON state which causes the pixel charging operational amplifier to operate as a buffer and a pixel is charged at a voltage corresponding to a voltage for a current gray-level display.

First Embodiment

Figure 1:
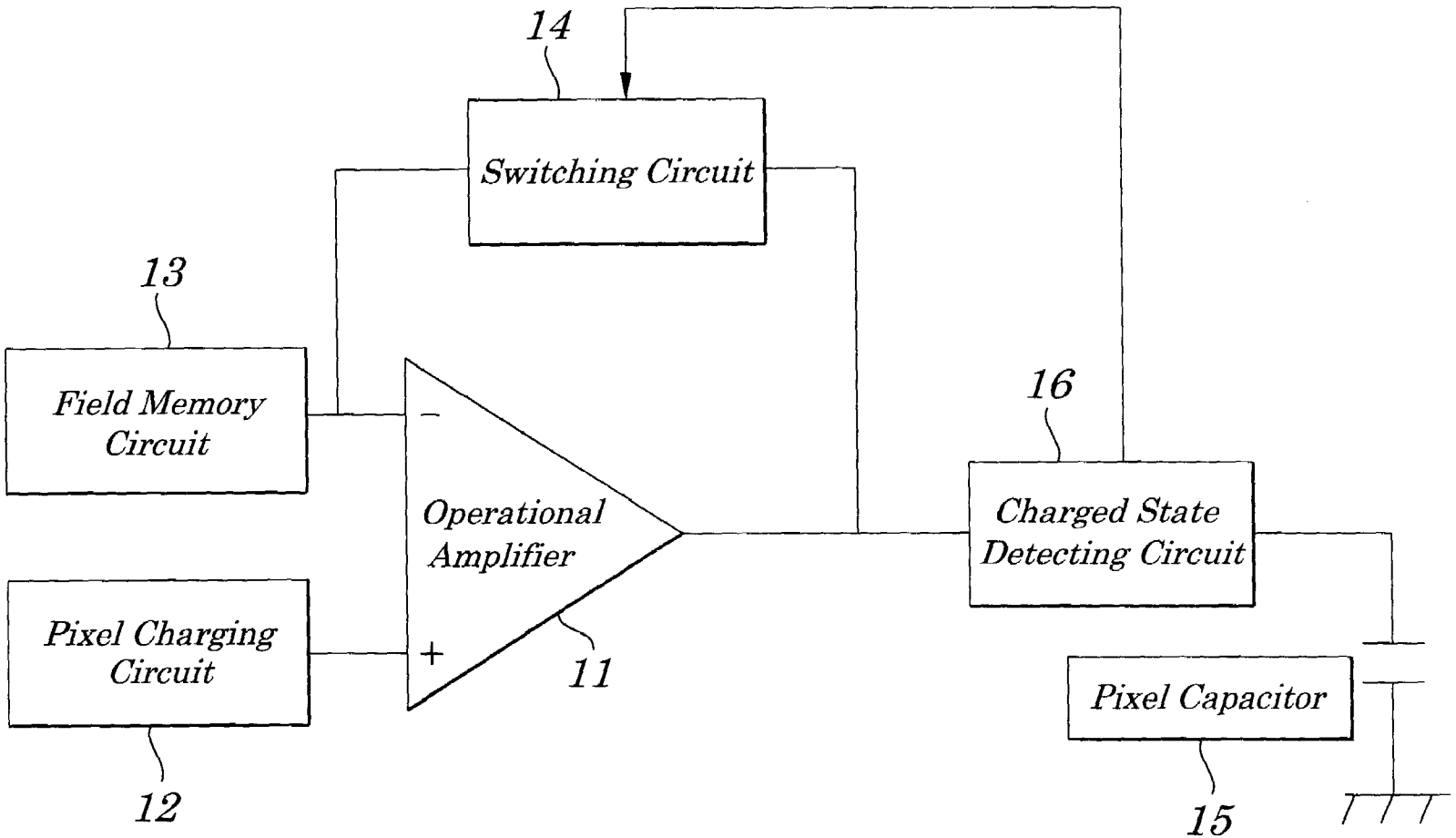
FIG. 1 is a block diagram showing general configurations of a driving circuit for an LCD panel according to a first embodiment of the present invention.
Figure 2:
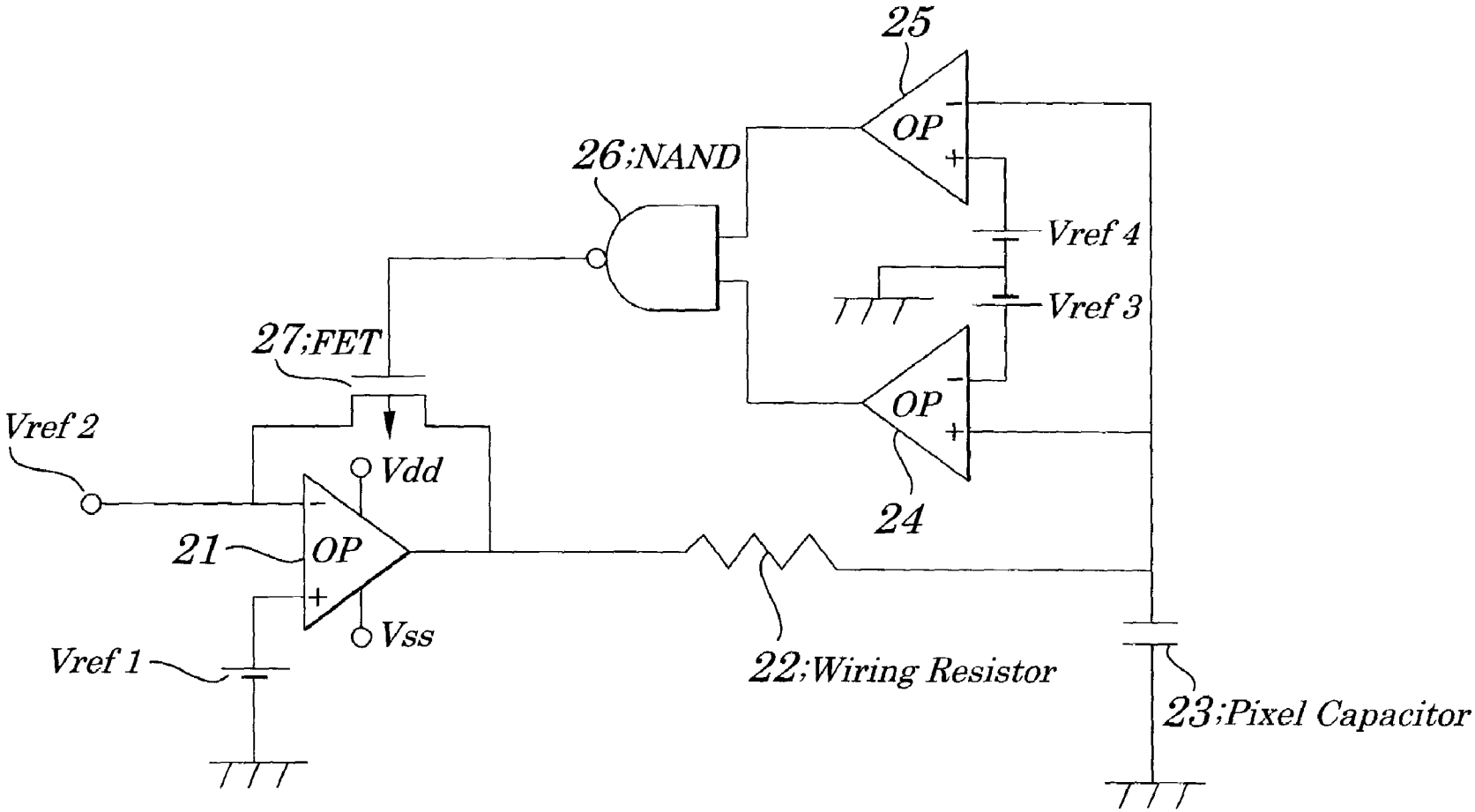
FIG. 2 is a circuit showing specified configurations of a driving circuit for the LCD panel according to the first embodiment of the present invention.
Figure 3:
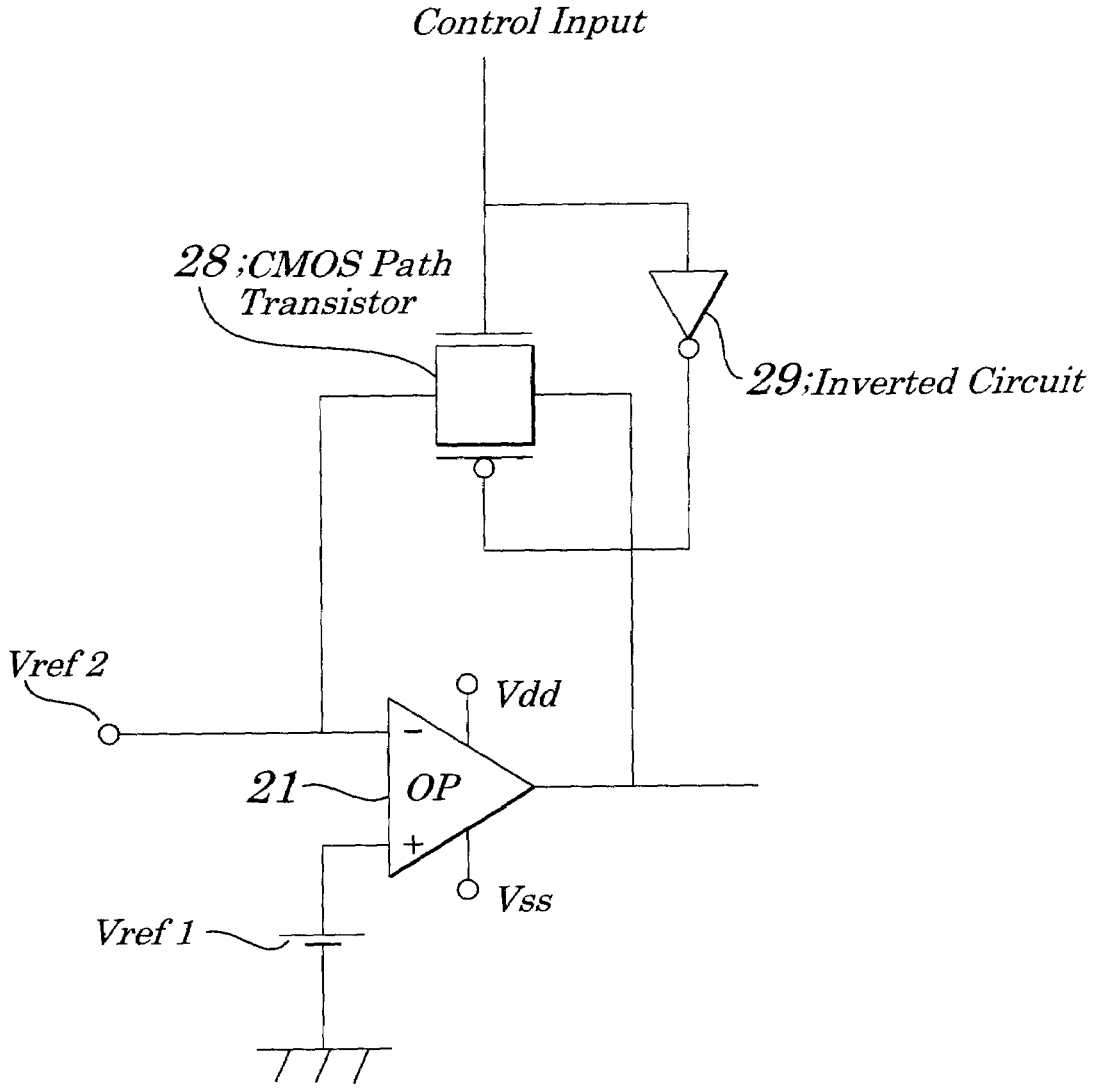
FIG. 3 is a diagram showing configurations of a switching circuit made up of CMOS path transistors.
Figure 4A:
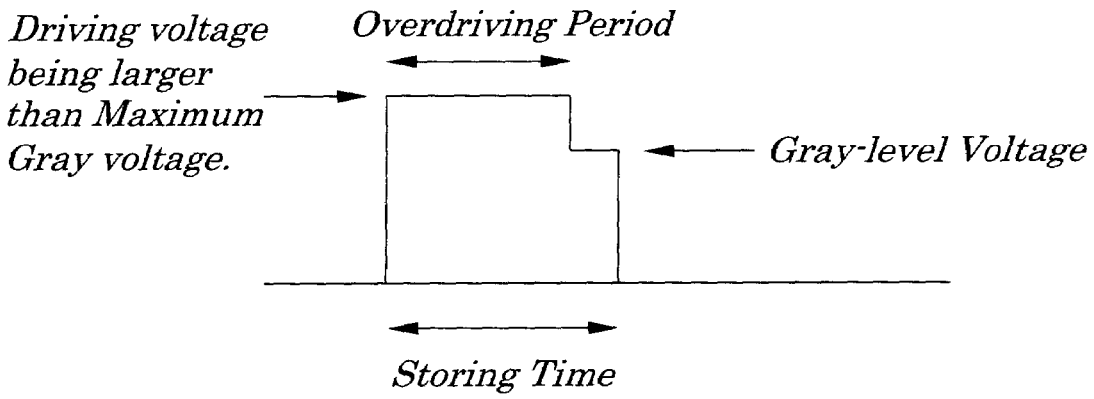
FIGS. 4A and 4B are diagrams schematically showing driving voltage waveforms occurring when gray level voltages are stored in the driving circuit for the LCD panel according to the first embodiment of the present invention.
Figure 4B:
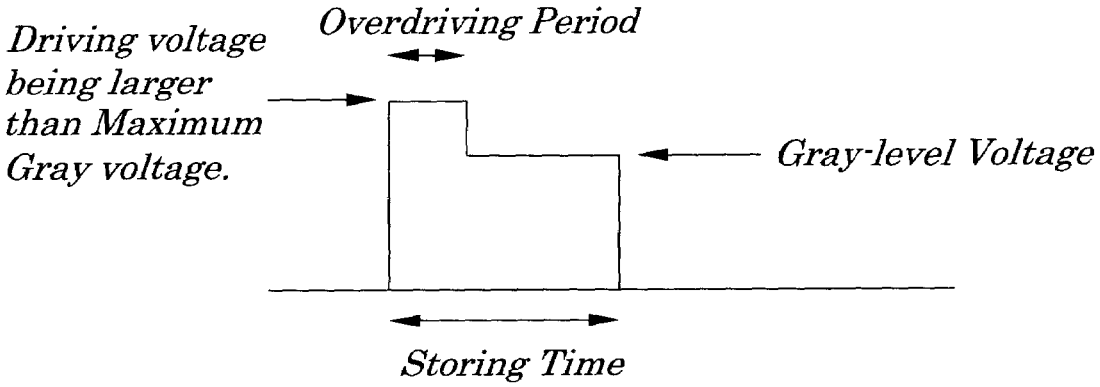

FIG. 1 is a block diagram showing general configurations of a driving circuit for an LCD panel of a first embodiment of the present invention. FIG. 2 is a schematic circuit diagram showing specified configurations of the driving circuit for the LCD panel of the first embodiment. FIG. 3 is a schematic diagram showing configurations of a switching circuit made up of CMOS (Complementary Metal-Oxide Semiconductor) path transistors. Also, FIGS. 4A and 4B are diagrams showing driving voltage waveforms occurring when gray level voltages are stored in the driving circuit for the LCD panel of the first embodiment.

The driving panel for the LCD panel, as shown in FIG. 1, chiefly includes an operational amplifier 11, a pixel charging circuit 12, a field memory circuit 13, a switching circuit 14, a pixel capacitor 15, and a charged state detecting circuit 16.

The operational amplifier 11 amplifies a non-inverted (+) input in the same phase (common mode) and an inverted input (−) in opposite phase and generates an output representing a difference between the two amplified results. The pixel charging circuit 12 generates power is used to charge a pixel electrode (not shown) so that the pixel electrode has a voltage corresponding to a gray scale. The field memory circuit 13 is made up of a memory section (not shown) used to store a pixel electrode voltage as a digital value and a D/A (Digital-to-Analog) converter (not shown) used to D/A convert a voltage value stored in the memory section. The switching circuit 14 goes into a state of high or low resistance depending on whether a control input is high (H) or low (L). The pixel capacitor 15 is a parallel capacitor of a pixel electrode (not shown) and its charging voltage is a typical voltage of pixel electrodes. The charged state detecting circuit 16, when a charging voltage approaches a predetermined value, outputs a control signal to make the switching circuit 14 go into a state of low resistance. Generally, a non-inverted input and an inverted input are respectively called a first input and a second input without making a distinction between the non-inverted input and inverted input since each of the non-inverted input and the inverted input can provide an equal operation by connecting the non-inverted and inverted inputs so as to be opposite to each other in phase using an inverter.

As shown in FIG. 1, to the non-inverted input terminal of the operational amplifier 11 is connected the pixel charging circuit 12 which generates a voltage to be used for charging the pixel electrode so that the pixel electrode can have a required gray level, and to the inverted input terminal is connected the pixel charging circuit 12 which stores a voltage of a corresponding pixel electrode occurred one field before as a digital voltage value and D/A converts the stored digital voltage value to output the voltage as an analog voltage.

Between the output terminal of the operational amplifier 11 and its inverted input terminal is connected the switching circuit 14 and, when the switching circuit 14 is turned ON, a low resistance state occurs between the output terminal of the operational amplifier 11 and the inverted input terminal and, when the switching circuit 14 is turned OFF, a high resistance state occurs between the output terminal of the operational amplifier 11 and its inverted input terminal. The switching circuit 14 is ordinarily in a high resistance state, however, when the charged state detecting circuit 16 detects that a voltage for charging the pixel capacitor 15 connected to the output terminal of the operational amplifier 11 approaches a predetermined value, the switching circuit 14 is turned ON by a detecting signal from the charging state detecting circuit 16 and goes into a low resistance state.

FIG. 2 is a diagram showing configurations of the driving circuit for the LCD panel of the first embodiment of the present invention which corresponds to the block diagram shown in FIG. 1. The driving circuit shown in FIG. 2 roughly includes an operational amplifier (OP) 21, a wiring resistor 22, a pixel capacitor 23, an operational amplifier (OP) 24, an operational amplifier (OP) 25, a NAND circuit 26, and an FET (Field Effect Transistor) 27.

A positive power supply Vdd and a negative power supply are connected to the OP 21. A pixel charging voltage Vref1 is applied from the pixel charging circuit 12 to the non-inverted (+) input terminal of the OP 21. A voltage Vref2 for charging a corresponding pixel occurred one field before is applied from the field memory circuit 13 to the inverted input terminal of the OP 21. An output terminal of the OP 21 is connected through the wiring resistor 22 to the pixel capacitor 23. An output terminal of the OP 24 is connected to the pixel capacitor 23 and a voltage Vref3 being slightly lower than the pixel charging voltage Vref1 is applied to an inverted input terminal of the OP 24. A voltage being slightly higher than the pixel charging voltage Vref1 is applied to a non-inverted input and the pixel capacitor 23 is connected to an inverted input. An output from the OP 24 is input to one of input terminals of the NAND 26 and an output from the OP 24 is input to the other input terminal of the NAND 26. An output from the NAND 26 is input to a gate of the FET 27 connected between the non-inverted input terminal of the OP 21 and an output terminal of the OP 21. The FET 27 is made up of, for example, a P-channel MOSFET.

In the driving circuit of the LCD panel shown in FIG. 2, the pixel capacitor 23 is charged by the output fed through the wiring resistor 22 from the OP 21. At this time point, a charged state of the pixel capacitor 23 is detected by the OP 24 and OP 25. Since the charging current to be applied to the pixel capacitor 23 is integrated by an integrating circuit made up of the wiring resistor 22 and the pixel capacitor 23, a charging voltage to be applied to the pixel capacitor 23 is input later than the pixel charging voltage Vref1. Therefore, it is desirous that the resistance of the wiring resistor 22 is much lower.

A voltage of the pixel capacitor 23 is input to a non-inverted input terminal of the OP 24 and a voltage Vref3 being slightly lower than the non-inverted input voltage Vref1 is input to an inverted input terminal of the OP21 and an output of the OP 24 becomes low when the voltage of the pixel capacitor 23 is lower than the voltage Vref3 and becomes high when the voltage of the pixel capacitor 23 is higher than the voltage Vref3. Moreover, the voltage of the pixel capacitor 23 is input to an inverted input terminal of the OP 25 and a voltage Vref4 being slightly higher than a non-inverted input voltage Vref1 of the OP 21 is input to the non-inverted input terminal of the OP 25 and an output of the OP 25 becomes high when the voltage of the pixel capacitor 23 is lower than the Vref4 and becomes high when the voltage of the pixel capacitor 23 is higher than the voltage Vref4. The voltages Vref3 and Vref4 are generated by making a voltage generating circuit (not shown) perform certain operations according to the pixel charging voltage Vref1.

The outputs from the OP 24 and OP 25 are applied to the NAND circuit 26. The NAND circuit 26 generates an output by performing a NAND operation on both the output from the OP 24 and OP 25 and, therefore, the output from the NAND circuit 26 becomes low when both the outputs from the OP 24 and OP 25 are high, that is, when a voltage of the pixel capacitor 23 is higher than the voltage Vref3 and becomes high at other times.

When a P-channel MOSFET is used as the FET 27, if a voltage of the pixel capacitor 23 is lower than the voltage Vref3 or higher than the voltage Vref4, that is, if the voltage of the pixel capacitor 23 deviates significantly from the pixel charging voltage Vref1 fed from the pixel charging circuit 12 occurring in a current field, the FET 27 goes into an OFF state and, therefore, the OP 21 operates as a comparator and pixel electrodes are overdriven by charging the pixel capacitor 23 by using the source voltage Vdd when the voltage Vref1 is higher than the voltage Vref2 and by using the source voltage Vss when the voltage Vref1 is smaller than the voltage Vref2.

On the other hand, when a voltage of the pixel capacitor 23 is higher than the voltage Vref3 and lower than the Vref4, that is, when the voltage of the pixel capacitor 23 is near to the pixel charging voltage Vref1 fed from the pixel charging circuit occurring in a current field, the FET 27 goes into an ON state. In this state, a state occurs in which a short circuit is made between an output from the OP21 and an inverted input and, therefore, the OP 21 operates as a buffer to stop overdriving and the output from the OP 21 varies depending on the Vref1 and the pixel capacitor 23 is finally charged to have the voltage Vref1.

At this time point, since the positive source voltage Vdd of the OP 21 is higher than a pixel charging voltage corresponding to a voltage at which operations are performed in maximum shades of gray and the negative source voltage Vss is lower than the pixel charging voltage corresponding to a voltage at which inverted operations are performed in maximum shades of gray, an output from the OP 21 occurring when operating as the comparator has a dynamic range being wider than that of the pixel charging voltage corresponding to the voltage at which inverted operations are performed in maximum shades of gray and at which operations are performed in maximum shades of gray. Moreover, the voltage at which inverted operations are performed in maximum shades of gray is equivalent to a voltage at which operations are performed in minimum shades of gray. This is because an inverted voltage of the maximum gray level voltage is the lowest when an LCD panel is AC (Alternating current) driven. Therefore, according to the driving circuit of the LCD panel of the embodiment, overdriving operations can be performed using the maximum voltage for any shade of gray.

As described above, in order to make the OP 21 operate as a comparator when a control input to the FET making up the switching circuit 14 is at a high level and to make the OP 21 operate as a buffer when the control input to the FET is at a low level, a P-channel MOSFET is used as the FET 27. On the other hand, in order to make the OP 21 operate as the comparator when a control input to the FET making up the switching circuit 14 is at a high level and to make the OP 21 operate as the buffer when the control input to the FET is at a high level, an N-channel MOSFET is used as the FET 27.

FIG. 3 shows an example of other configurations of the switching circuit where a CMOS path transistor is used as the switching circuit 14. In FIG. 3, only main components of the switching circuit 14 are shown which roughly includes an OP 21, a CMOS path transistor 28, and an inverted circuit 29. The CMOS path transistor 28 switches operation states of the switching circuit 14 between the state in which the OP 21 operates as a comparator and the state in which the OP 21 operate as a buffer in a manner that, the CMOS path transistor 28 is turned OFF when a control input is at a low level, which makes a high resistance state occur between an inverted input of the OP 21 and an output of the OP 21 and the CMOS path transistor 28 is turned ON when the control input is a high level, which makes a low resistance state occur between the inverted input of the OP 21 and its output. It is needless to say that, by changing connection so that an output terminal of the inverted circuit 29 is directly connected to a N-channel gate of the CMOS path transistor 28 and so that a control input is directly applied to a P-channel gate of the CMOS path transistor, the CMOS path transistor 28 is turned ON when the control input is at a low level and is turned OFF when the control input is at a high level.

FIGS. 4A and 4B are diagrams schematically showing driving voltage waveforms occurring when gray level voltages are stored in the driving circuit for the LCD panel according to the first embodiment of the present invention. FIG. 4A shows a waveform occurring when a difference in gray level between in current and previous fields is large and, as shown in FIG. 4A, a period during which overdriving by using a driving voltage being larger than the maximum gray level voltage is performed is longer. FIG. 4B shows a waveform occurring when a difference in gray level between in current and previous fields is small and, as shown in FIG. 4B, the period during which overdriving by using a driving voltage being larger than the maximum gray-level voltage is performed is shorter.

Therefore, in the driving circuit for the LCD panel of the first embodiment, if a difference in writing voltage between current and previous fields is large, the overdriving period is automatically made longer and if the difference in writing voltage between current and previous fields is small, the overdriving period is automatically made shorter and, as a result, processes are not required in which the driving period is predetermined based on experimental results or a like and the predetermined driving period is to be stored in a memory or a like.

Thus, according to the driving circuit of the LCD panel of the first embodiment, a voltage for charging a pixel electrode in a current field is applied to a non-inverted input terminal of the operational amplifier operating in a voltage range being wider than a gray level voltage range of the LCD panel. A voltage charging a corresponding pixel occurred one field before is applied to an inverted input terminal of the operational amplifier. A charged state of a pixel electrode is detected by a voltage value of a pixel capacitor. If a value representing the charged state deviates significantly from a set value, the switching circuit connected between the output terminal of the operational amplifier and its inverted input terminal is configured to go into an OFF state to make the operational amplifier operate as the comparator. When a value representing the charged state of the pixel electrode approaches the set value, the switching circuit is configured to go into an ON state to switch operations of the operational amplifier from an operation to be performed as the comparator to an operation to be performed as the buffer, which enables the overdriving operation to be performed in all shades of gray. Moreover, when a voltage of the pixel electrode approaches a set value, the overdriving operation is automatically stopped and, as a result, it is not necessary that a driving pattern is predetermined based on experimental results or a like. The driving circuit for the LCD panel can be easily applied to various products accordingly.

Second Embodiment

Figure 5:
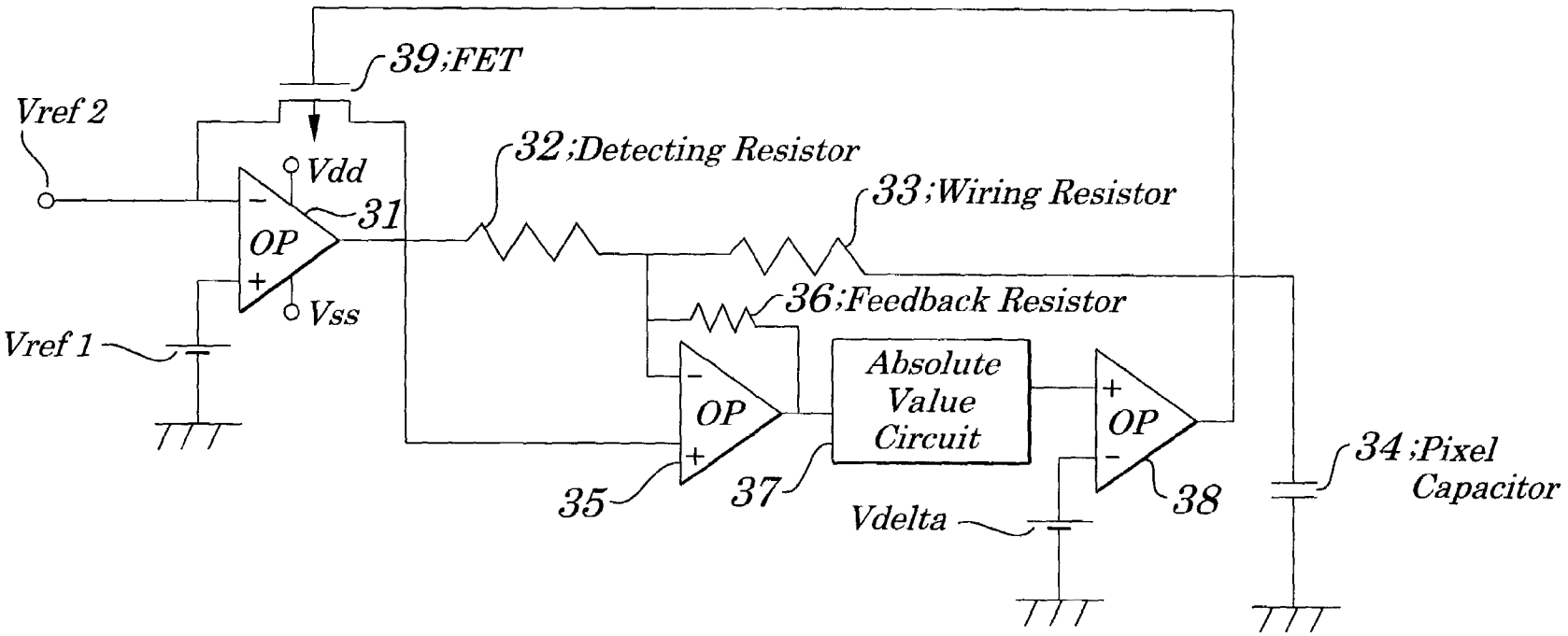
FIG. 5 is a circuit diagram showing specified configurations of a driving circuit for an LCD panel according to a second embodiment of the present invention.
Figure 6:
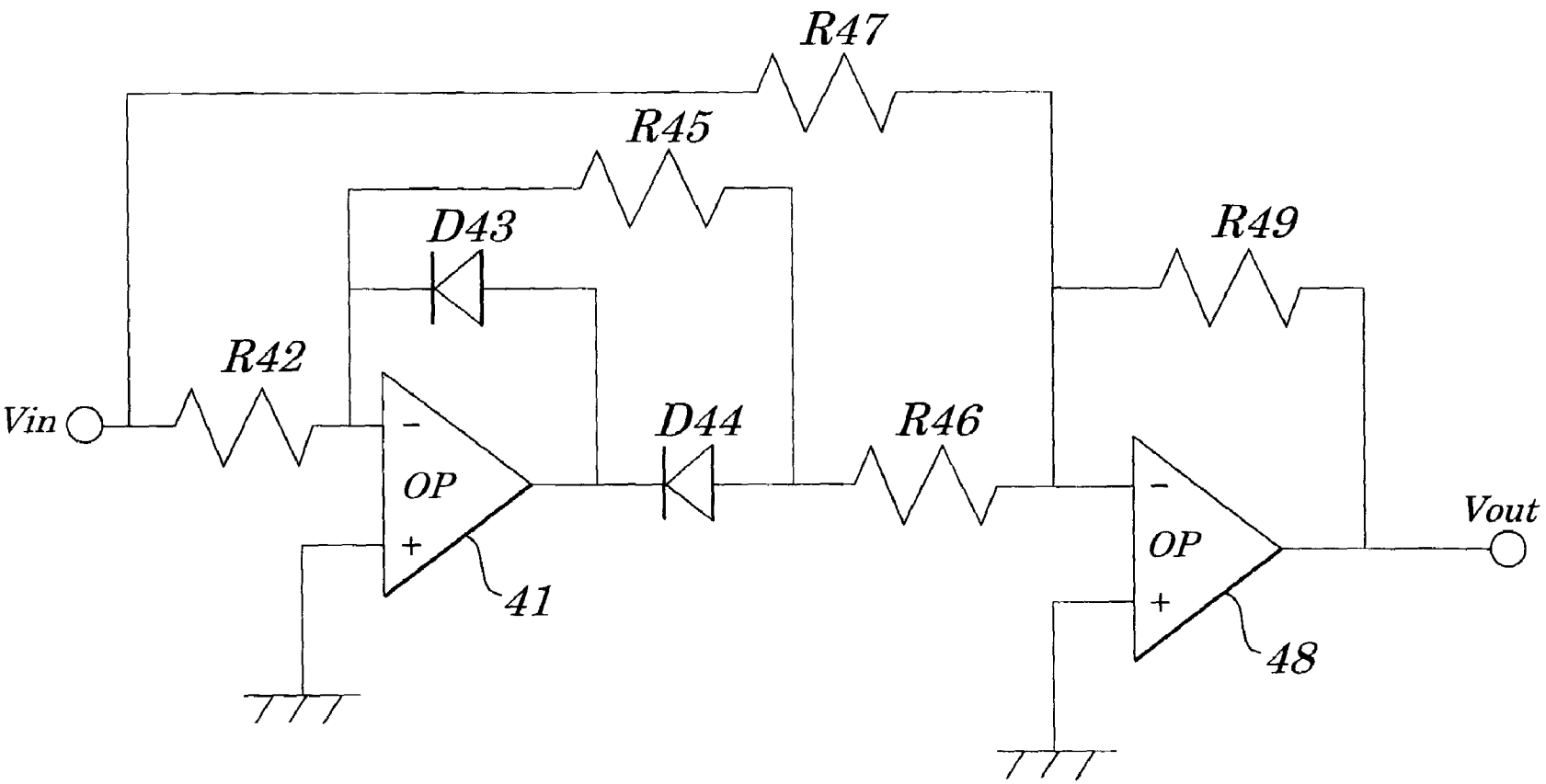
FIG. 6 is a circuit diagram showing specified configurations of an absolute value circuit for an LCD panel according to the second embodiment of the present invention.
Figure 7:
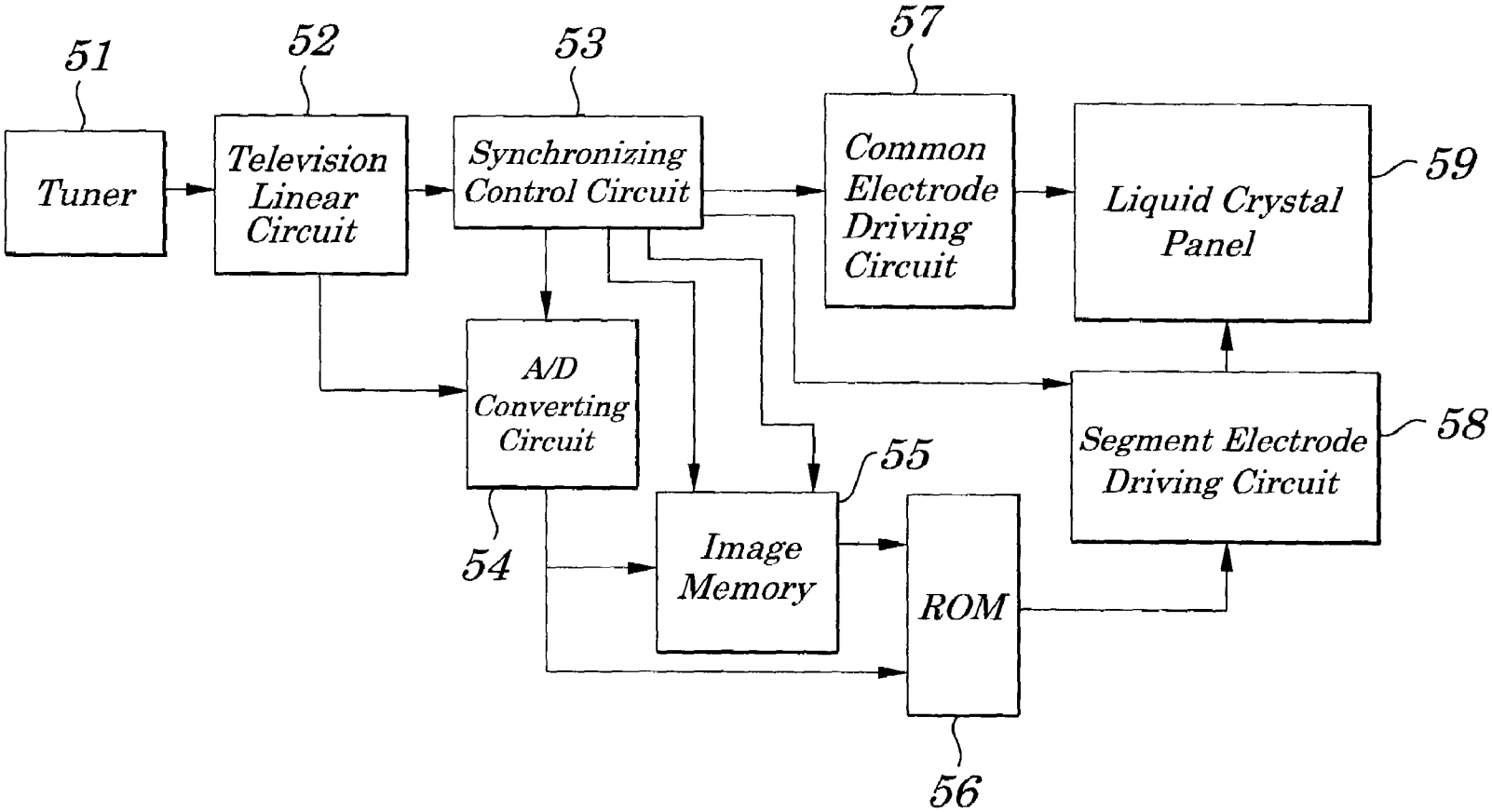
FIG. 7(RELATED ART)
FIG. 7 is a diagram showing an example of configurations of a conventional liquid crystal television set.

FIG. 5 is a schematic circuit diagram for showing specified configurations of a driving circuit for an LCD panel according to a second embodiment of the present invention. FIG. 6 is a schematic circuit diagram showing specified configurations of an absolute value circuit for the LCD panel according to the second embodiment. FIG. 5 shows circuit configurations of the second embodiment of the present invention, which corresponds to the block diagram shown in FIG. 1 and chiefly includes an OP 31, a detecting resistor 32, a wiring resistor 33, a pixel capacitor 34, an OP 35, a feedback resistor 36, an absolute value circuit 37, an OP 38, and an FET 39.

The OP 31 is connected to a positive power supply Vdd and to a negative power supply Vss. A pixel charging voltage Vref1 is fed from a pixel charging circuit 12 to a non-inverted input terminal of the OP 31. A charging voltage Vref2 of a corresponding pixel occurred one field before is fed from a field memory circuit 13 to an inverted input of the OP 31. An output from the OP 31 is applied through the detecting resistor 32 used to detect a charging current and the wiring resistor 33 to the pixel capacitor 34. A non-inverted input terminal of the OP 35 is connected to one end on the OP 31 side of the detecting resistor 32. An inverted input terminal of the OP 35 is connected to the other end of the detecting resistor 32. The feedback resistor 36 used to set an amplifying rate at a specified value is connected between an inverted input terminal of the OP 35 and its output terminal. An output from the OP 35 is full-wave rectified by the absolute value circuit 37 and is then output. A non-inverted input terminal of the OP 38 is connected to an output terminal of the absolute value circuit 37 and a voltage Vdelta used to judge whether or not a charging current fed to the pixel capacitor 34 has become sufficiently small is applied to an inverted input terminal of the OP 38. An output terminal of the OP 38 is connected to a gate of the FET 39 connected between the inverted input terminal of the OP 31 and the output terminal of the OP 38. The FET 39 is made up of, for example, a P-channel MOSFET.

In the driving circuit of the LCD panel shown in FIG. 5, a value of the charging current fed to the pixel capacitor 34 is detected by the OP 35 for every driving of the pixel. When charging of the pixel capacitor 34 proceeds, the charging current becomes small and a drop in voltage across the detecting resistor 32 becomes small and, therefore, a voltage output from the OP 35 becomes small and, as a result, an output from the absolute value circuit 37 connected to the non-inverted input terminal of the OP 38 also becomes small. The OP 38 operates as a comparator to compare a voltage value output from the absolute value circuit 37 fed to the non-inverted input terminal of the OP 38 with the voltage Vdelta fed to the inverted input terminal of the OP 38 and generates a high-level output when the non-inverted input is larger than the inverted input, that is, when the charging current fed to the pixel capacitor 34 exceeds a specified value and also generates a low-level output when the inverted input is larger than the non-inverted input, that is, when the charging current fed to the pixel capacitor 34 becomes smaller than the specified value.

Therefore, in the case where the P-channel MOSFET is used as the FET 39, if the charging of the pixel capacitor 34 does not proceed and a value of the charging current is not small, an input to the gate is at a high level and the FET 39 is in an OFF state and the OP 31 operates as the comparator and overdrives the pixel electrode by using the positive source voltage Vdd when the pixel charging voltage Vref1 is larger than the charging voltage Vref2 of a corresponding pixel occurred one field before and by using the negative source voltage Vss when the voltage Vref1 is smaller than the voltage Vref2.

On the other hand, when the charging of the pixel capacitor 34 proceeds and a value of the charging current becomes sufficiently small, that is, when a voltage for charging the pixel capacitor 34 sufficiently approaches the pixel charging voltage Vref1 output from the pixel charging circuit 12, an input of the gate is at a low level and, therefore, the FET 39 goes in an ON state and the OP 31 operates as a buffer and, as a result, the overdriving operation is stopped and an output from the OP 31 becomes a voltage corresponding to the voltage Vref1 and the pixel capacitor 34 is charged so as to finally become the voltage Vref1.

At this time point, since the positive source voltage Vdd of the OP 31 is higher than a pixel charging voltage corresponding to a voltage at which operations are performed in maximum shades of gray and the negative source voltage Vss is lower than the pixel charging voltage corresponding to a voltage at which inverted operations are performed in maximum shades of gray, an output of the OP 31 occurring when operating as the comparator has a dynamic range being wider than that of the pixel charging voltage corresponding to the voltage at which inverted operations are performed in maximum shades of gray and at which operations are performed in maximum shades of gray. Therefore, according to the driving circuit of the LCD panel of the embodiment, as in the case of the first embodiment, overdriving operations at the maximum voltage can be performed for any shade of gray.

Moreover, as in the case of the first embodiment shown in FIG. 4, if a difference in writing voltage between current and previous fields is large, the overdriving period is made longer and, if the difference in writing voltage between in current and previous fields is small, the overdriving period is made shorter. Thus, according to the driving circuit for the LCD panel of the second embodiment, when a difference in writing voltage between current and previous fields is large, the overdriving period is automatically made longer and when the difference in writing voltage between current and previous fields is small, the overdriving period is automatically made shorter and, as a result, processes are not required in which the driving period is predetermined based on experimental results or a like and the predetermined driving period is to be stored in a memory or a like.

Also, according to the driving circuit for the LCD panel of the second embodiment, a voltage for charging a pixel electrode in a current field is applied to a non-inverted input terminal of the operational amplifier operating in a voltage range being wider than a gray-level voltage range of the LCD panel. A voltage for charging a corresponding pixel occurred one field before is applied to an inverted input terminal of the operational amplifier. A charged state of a pixel electrode is detected by a voltage value of the pixel capacitor. If a value representing the charged state deviates significantly from a set value, the switching circuit connected between the output terminal of the operational amplifier and its inverted input terminal is configured to go into an OFF state to make the operational amplifier operate as a comparator. When a value representing the charged state of the pixel electrode approaches the set value, the switching circuit is configured to go into an ON state to switch operations of the operational amplifier from an operation to be performed as the comparator to an operation to be performed as the buffer, which enables the overdriving operation in all shades of gray. Moreover, when a voltage of the pixel electrode approaches a set value, the overdriving operation is automatically stopped and, as a result, it is not necessary that a driving pattern is predetermined based on experimental results or a like. The driving circuit for the LCD panel can be easily applied to various products accordingly.

FIG. 6 is a schematic circuit diagram for showing specified configurations of an absolute value circuit for an LCD panel according to the second embodiment of the present invention in which the absolute value circuit performs full-wave rectification by using a general operational amplifier. The absolute value circuit, as shown in FIG. 6, roughly includes an OP (Operational Amplifier) 41, an R (Resistor) 42, a D (Diode) 43, a D (Diode) 44, an R 45, an R 46, an R 47, an OP 48, and an R 49.

In the absolute value circuit shown in FIG. 6, the OP 41 and circuits surrounding the OP 41 make up a halfwave rectifier that operates only when an input Vin is positive and in which the OP 48 and circuits surrounding the OP 48 make up an adding circuit that generates an output by adding an output from the halfwave rectifier including the OP 41 to the input having a negative voltage. The halfwave rectifier and adding circuit, as a whole, operate as the absolute value circuit and full-wave rectify the input voltage having a positive or negative voltage to output an voltage Vout. Moreover, configurations other than described above operating as an absolute value circuit are not limited to the circuit shown in FIG. 6.

It is apparent that the present invention is not limited to the above embodiments but may be changed and modified without departing from the scope and spirit of the invention. For example, in the above embodiments, the FET 22 and FET 39 making up the switching circuit 14 are made up of a P-channel MOSFET, however, by inverting a voltage to be applied to a gate, instead of the P-channel MOSFET, an N-channel MOSFET may be used.

Similarly, the operational amplifiers 24, 25 shown in FIG. 2 and the operational amplifier 38 shown in FIG. 5, as required, each may be displaced with a comparator or a like.

Moreover, as the switching circuit 14, a CMOS path transistor may be employed. Furthermore, as the absolute circuit 37, any circuit having configurations being different from those described in the second embodiment, so long as the circuit has the same functions as in the absolute circuit 37 shown in FIG. 5, may be employed.

The driving circuit for the LCD panel of the present invention can be generally employed in a display panel of a liquid crystal television set, a liquid crystal display panel of a portable phone, and in personal computers using a liquid crystal panel as a display device.

What is claimed is:

1. A driving circuit for an LCD (Liquid Crystal Display) panel comprising:

a pixel charging operational amplifier, to a first input terminal of which a voltage to charge a pixel of said LCD for a current gray-scale display is applied and to a second input terminal of which a voltage to charge a corresponding pixel occurred one field before is applied and an output from which is supplied to said pixel and to which a source voltage having a positive or negative voltage range being wider than a gray-level voltage range of said LCD panel is applied;

a charged state detecting unit to detect a charged state of said pixel and to generate an output being different depending on whether a value representing said charged state is within a range of a large deviation from a set value or is within a range of a small deviation from said set value; and a switching unit to cause an OFF state or ON state to occur between said second input terminal of said pixel charging operational amplifier and its output terminal according to an output state of said charged state detecting unit;

wherein, when a value representing a charged state of said pixel is within a range significantly deviating from said set value, said switching unit goes into an OFF state which makes said pixel charging operational amplifier operate as a comparator and makes said pixel to be overdriven using said positive or negative source voltage and, when said value representing a charged state of said pixel is within a range of a small deviation from said set value, said switching unit goes into an ON state which makes said pixel charging unit operate as a buffer and makes said pixel be charged by using a voltage corresponding to a current gray-scale display.

2. The driving circuit for the LCD panel according to claim 1, wherein a voltage for charging a corresponding pixel occurred one field before is generated by a field memory device having a memory unit to store said voltage for charging a corresponding pixel occurred one field before as a digital value and a D/A (Digital/Analog) converting unit to convert said digital value into an analog value.

3. The driving circuit for the LCD panel according to claim 1, wherein said charged state detecting unit comprising:

a first operational amplifier, to a first input terminal of which a voltage for charging a pixel capacitor is applied and to a second input terminal of which a voltage being slightly lower than a voltage to charge said pixel for a current gray-scale display is applied;

a second operational amplifier, to said second input terminal of which said voltage for charging said pixel capacitor and to said first input terminal of which a voltage being slightly higher than a voltage for charging said pixel for a current gray-level display is applied; and a logical operation unit to perform logical operations on an output from said first operational amplifier and an output from said second operational amplifier to generate an output obtained from said logical computation.

4. The driving circuit for the LCD panel according to claim 1, wherein said charged state detecting unit comprises:

an operational amplifier for amplification to amplify a voltage detected by a detecting resistor connected between an output terminal of said pixel charging operational amplifier and said pixel capacitor to obtain a predetermined gain;

an absolute value circuit to full-wave rectify a voltage output from said operational amplifier for amplification and to generate an output having a specified signal; and an operational amplifier for comparison to compare a voltage output from said absolute circuit with a specified voltage having a same signal as said voltage output from said absolute circuit to generate an output obtained from the comparison.

5. The driving circuit for the LCD panel according to claim 1, wherein said switching unit comprises a P-channel MOSFET (Metal-Oxide Semiconductor Field Effect Transistor) whose gate is connected between a second input terminal of said pixel charging operational amplifier and its output terminal is connected to an output terminal of said charged state detecting unit and wherein, when an output from said charged state detecting unit is at a high level, an OFF state occurs between said second input terminal of said pixel charging operational amplifier and its output terminal and, when an output from said charged state detecting unit is at a low level, an OFF state occurs between said second input terminal of said pixel charging operational amplifier and its output terminal.

6. The driving circuit for the LCD panel according to claim 1, wherein said switching unit comprises a N-channel MOSFET whose gate connected between said second input terminal of said pixel charging operational amplifier and its output terminal is connected to an output terminal of said charged state detecting unit and wherein, when an output from said charged state detecting unit is at a low level, an OFF state occurs between said second input terminal of said pixel charging operational amplifier and its output terminal and, when an output from said charged state detecting unit is at a high level, an ON state occurs between said second input terminal of said pixel charging operational amplifier and its output terminal.

7. The driving circuit for the LCD panel according to claim 1, wherein said switching unit comprises a CMOS (Complementary Metal-Oxide Semiconductor) connected between said second input terminal of said pixel charging operational amplifier and its output terminal and whose control input is connected to an output terminal of said charged state detecting unit and wherein, when an output from said charged state detecting unit is at a low level, an OFF state occurs between said second input terminal of said pixel charging operational amplifier and its output and, when an output from said charged state is at a high level, an ON state occurs between said pixel charging operational amplifier and its output.

8. A driving circuit for an LCD (Liquid Crystal Display) panel comprising:

a pixel charging operational amplifier, to a first input terminal of which a voltage to charge a pixel of said LCD for a current gray-scale display is applied and to a second input terminal of which a voltage to charge a corresponding pixel occurred one field before is applied and an output from which is supplied to said pixel and to which a source voltage having a positive or negative voltage range being wider than a gray-level voltage range of said LCD panel is applied;

a charged state detecting means to detect a charged state of said pixel and to generate an output being different depending on whether a value representing said charged state is within a range of a large deviation from a set value or is within a range of a small deviation from said set value; and a switching means to cause an OFF state or ON state to occur between said second input terminal of said pixel charging operational amplifier and its output terminal according to an output state of said charged state detecting means;

wherein, when a value representing a charged state of said pixel is within a range significantly deviating from said set value, said switching means goes into an OFF state which makes said pixel charging operational amplifier operate as a comparator and makes said pixel to be overdriven using said positive or negative source voltage and, when said value representing a charged state of said pixel is within a range of a small deviation from said set value, said switching means goes into an ON state which makes said pixel charging means operate as a buffer and makes said pixel be charged by using a voltage corresponding to a current gray-scale display.

9. The driving circuit for the LCD panel according to claim 8, wherein a voltage for charging a corresponding pixel occurred one field before is generated by a field memory device having a memory means to store said voltage for charging a corresponding pixel occurred one field before as a digital value and a D/A (Digital/Analog) converting means to convert said digital value into an analog value.

10. The driving circuit for the LCD panel according to claim 8, wherein said charged state detecting means comprising:

a first operational amplifier, to a first input terminal of which a voltage for charging a pixel capacitor is applied and to a second input terminal of which a voltage being slightly lower than a voltage to charge said pixel for a current gray-scale display is applied;

a second operational amplifier, to said second input terminal of which said voltage for charging said pixel capacitor and to said first input terminal of which a voltage being slightly higher than a voltage for charging said pixel for a current gray-level display is applied; and a logical operation means to perform logical operations on an output from said first operational amplifier and an output from said second operational amplifier to generate an output obtained from said logical computation.

11. The driving circuit for the LCD panel according to claim 8, wherein said charged state detecting means comprises:

an operational amplifier for amplification to amplify a voltage detected by a detecting resistor connected between an output terminal of said pixel charging operational amplifier and said pixel capacitor to obtain a predetermined gain;

an absolute value circuit to full-wave rectify a voltage output from said operational amplifier for amplification and to generate an output having a specified signal; and an operational amplifier for comparison to compare a voltage output from said absolute circuit with a specified voltage having a same signal as said voltage output from said absolute circuit to generate an output obtained from the comparison.

12. The driving circuit for the LCD panel according to claim 8, wherein said switching means comprises a P-channel MOSFET (Metal-Oxide Semiconductor Field Effect Transistor) whose gate is connected between a second input terminal of said pixel charging operational amplifier and its output terminal is connected to an output terminal of said charged state detecting means and wherein, when an output from said charged state detecting means is at a high level, an OFF state occurs between said second input terminal of said pixel charging operational amplifier and its output terminal and, when an output from said charged state detecting means is at a low level, an OFF state occurs between said second input terminal of said pixel charging operational amplifier and its output terminal.

13. The driving circuit for the LCD panel according to claim 8, wherein said switching means comprises a N-channel MOSFET whose gate connected between said second input terminal of said pixel charging operational amplifier and its output terminal is connected to an output terminal of said charged state detecting means and wherein, when an output from said charged state detecting means is at a low level, an OFF state occurs between said second input terminal of said pixel charging operational amplifier and its output terminal and, when an output from said charged state detecting means is at a high level, an ON state occurs between said second input terminal of said pixel charging operational amplifier and its output terminal.

14. The driving circuit for the LCD panel according to claim 8, wherein said switching means comprises a CMOS (Complementary Metal-Oxide Semiconductor) connected between said second input terminal of said pixel charging operational amplifier and its output terminal and whose control input is connected to an output terminal of said charged state detecting means and wherein, when an output from said charged state detecting means is at a low level, an OFF state occurs between said second input terminal of said pixel charging operational amplifier and its output and, when an output from said charged state is at a high level, an ON state occurs between said pixel charging operational amplifier and its output.

* * * * *